US012680252B2

(12) United States Patent
Justino

(10) Patent No.: US 12,680,252 B2
(45) Date of Patent: Jul. 14, 2026

(54) METHOD FOR MANUFACTURING AN ELEMENT COMPRISING A GROUT ACTIVATION CYCLE

(71) Applicant: SOLETANCHE FREYSSINET, Rueil Malmaison (FR)

(72) Inventor: Christophe Justino, Rueil Malmaison (FR)

( * ) Notice: Subject to any disclaimer, the term of this patent is extended or adjusted under 35 U.S.C. 154(b) by 181 days.

(21) Appl. No.: 18/574,327

(22) PCT Filed: Jun. 23, 2022

(86) PCT No.: PCT/EP2022/067279

§ 371 (c)(1),
(2) Date: Dec. 27, 2023

(87) PCT Pub. No.: WO2023/274853

PCT Pub. Date: Jan. 5, 2023

(65) Prior Publication Data

US 2024/0318396 A1 Sep. 26, 2024

(30) Foreign Application Priority Data

Jun. 30, 2021 (FR) ..... 2107053

(51) Int. Cl.
*E02D 3/12* (2006.01)

(52) U.S. Cl.
CPC ..... *E02D 3/12* (2013.01); *E02D 2250/003* (2013.01); *E02D 2300/0018* (2013.01)

(58) Field of Classification Search
CPC ..... E02D 3/12; E02D 5/18; E02D 2250/003; E02D 2300/0018
See application file for complete search history.

(56) References Cited

U.S. PATENT DOCUMENTS

| | | | | |
|---|---|---|---|---|
| 3,802,203 | A * | 4/1974 | Ichise | E02D 3/12 405/269 |
| 3,908,387 | A | 9/1975 | Nakamura | |
| 9,976,272 | B2 | 5/2018 | Freyssinet | |
| 2004/0244997 | A1* | 12/2004 | Stotzer | E02D 3/126 172/1 |
| 2012/0308306 | A1 | 12/2012 | Kruse | |
| 2016/0145825 | A1* | 5/2016 | Steff De Verninac | E02F 1/00 405/284 |
| 2022/0025603 | A1* | 1/2022 | Da Costa | E02D 3/12 |

FOREIGN PATENT DOCUMENTS

| | | | |
|---|---|---|---|
| GB | 796959 | A | 6/1958 |
| GB | 965372 | A | 7/1964 |

* cited by examiner

*Primary Examiner* — Benjamin F Fiorello

(57) ABSTRACT

A method for manufacturing an element in a ground comprising a drilling step during which a grout comprising a first composition is introduced and after the drilling step, at least one grout activation cycle is performed during which at least part of the grout is pumped; a second composition configured to activate the grout by reacting with the first composition in order to initiate the hardening of said grout is added to the pumped grout; then the activated grout is introduced into the excavation; and after said at least one grout activation cycle, the activated grout is allowed to harden in order to form the element in the ground.

25 Claims, 9 Drawing Sheets

[Fig. 1]
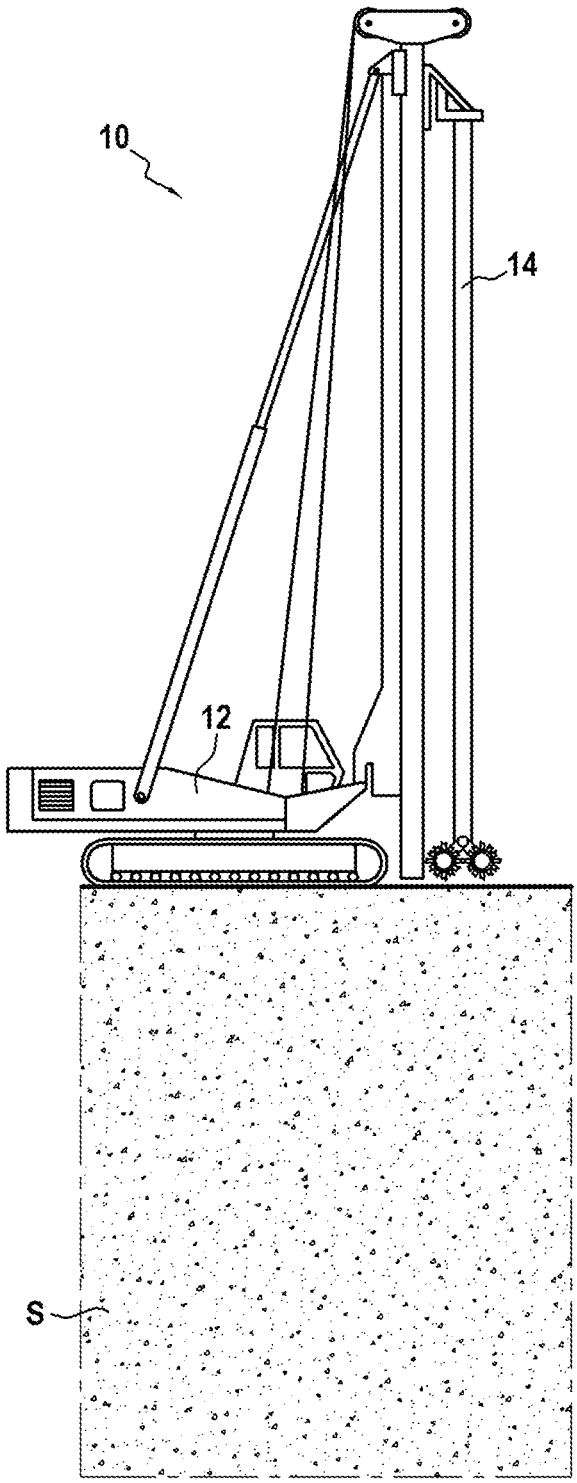

[Fig. 2]
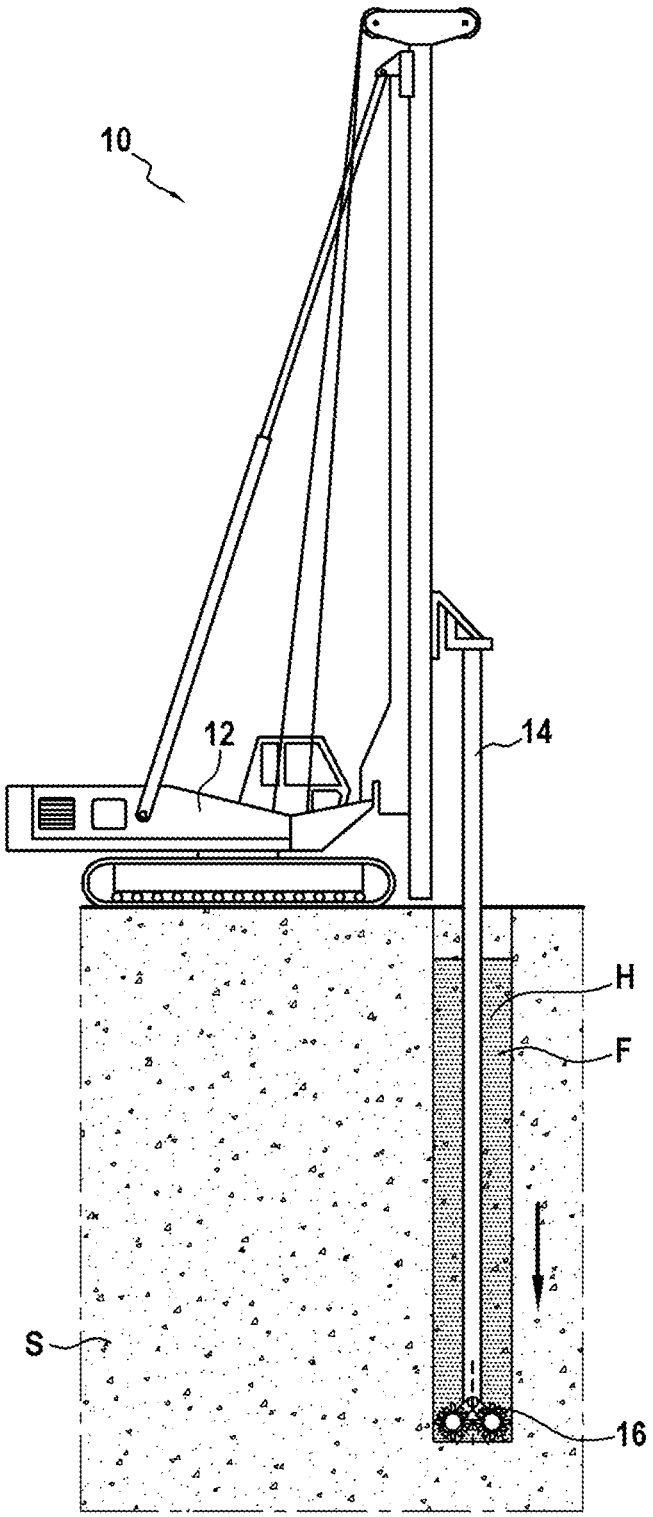

[Fig. 3]
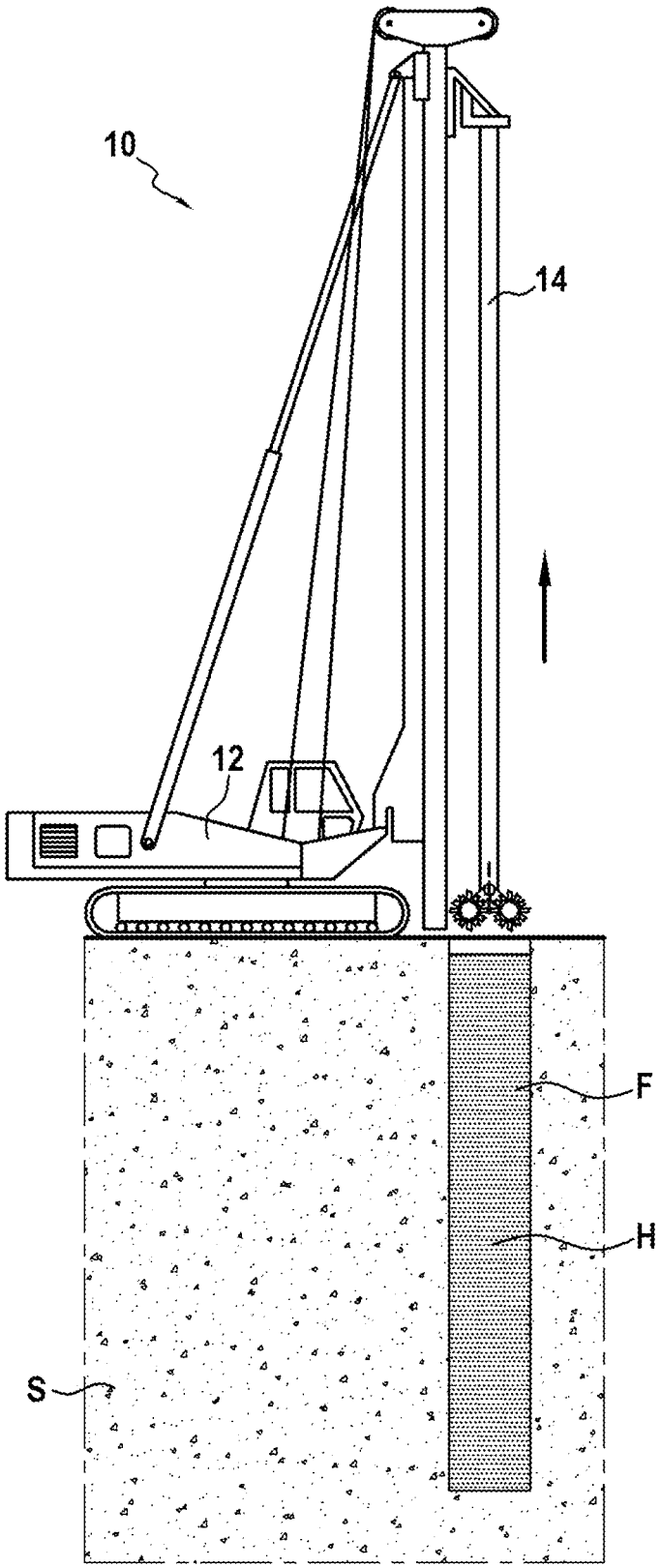

[Fig. 4]
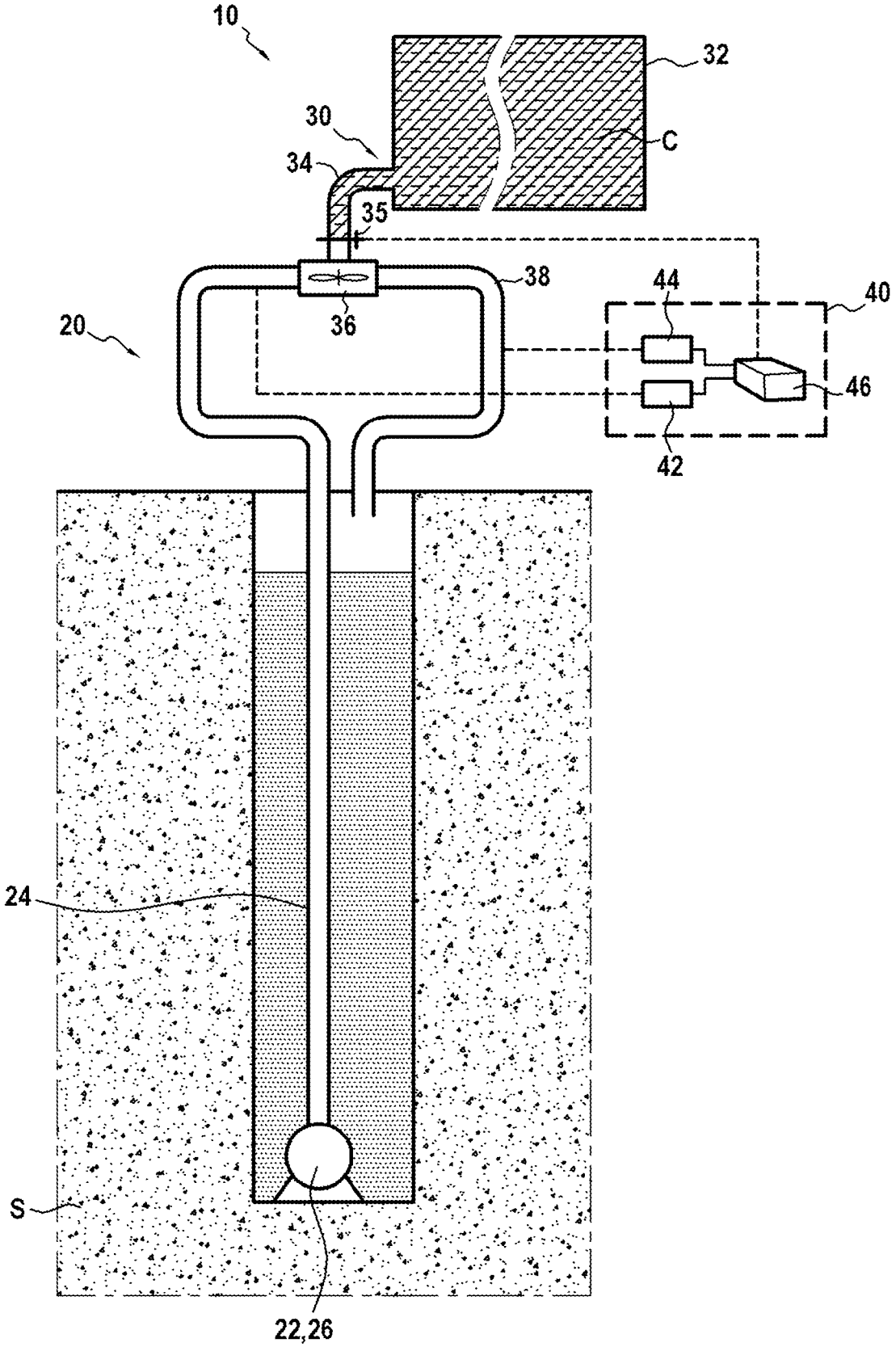

[Fig. 5]
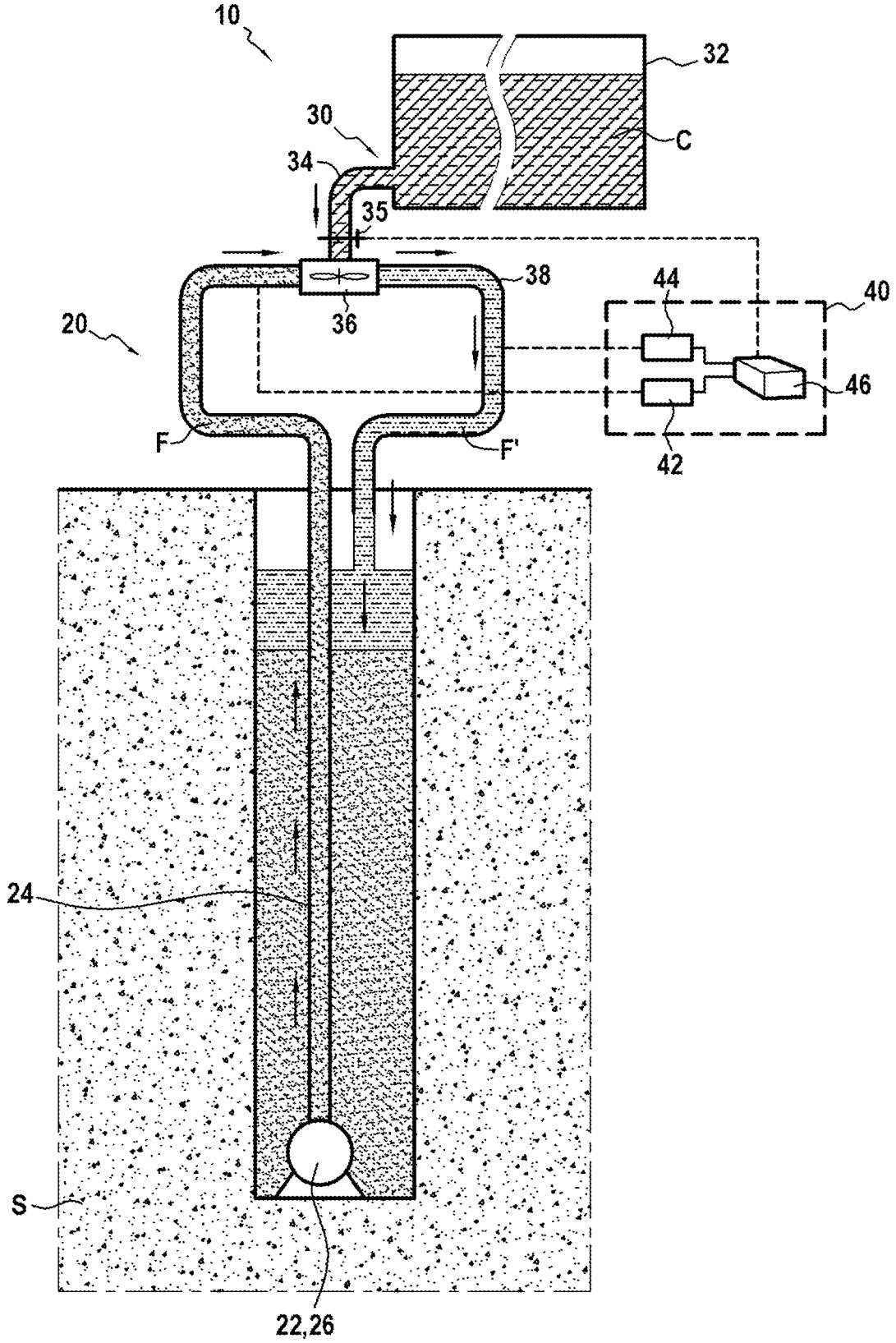

[Fig. 6]
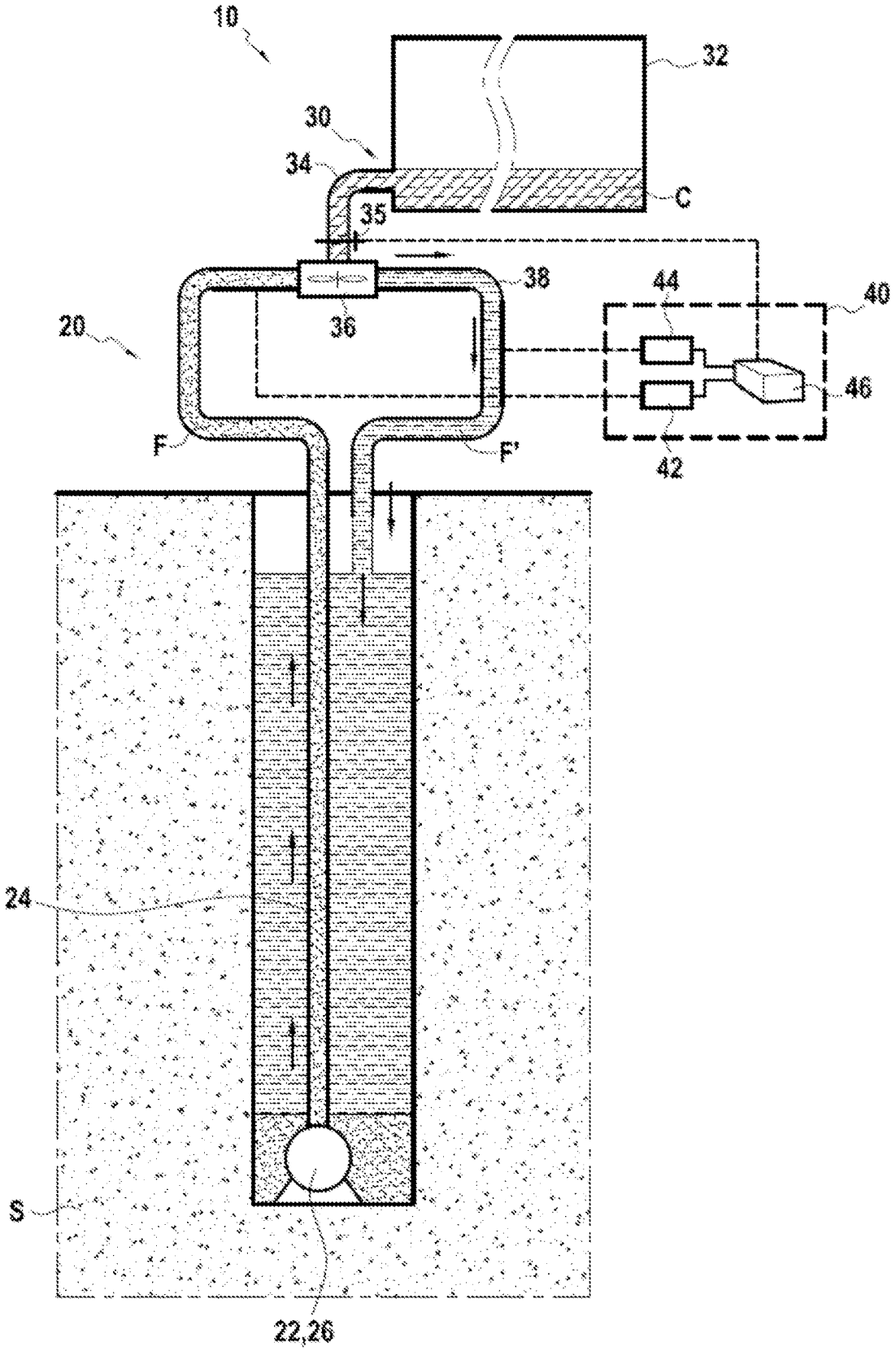

[Fig. 7]
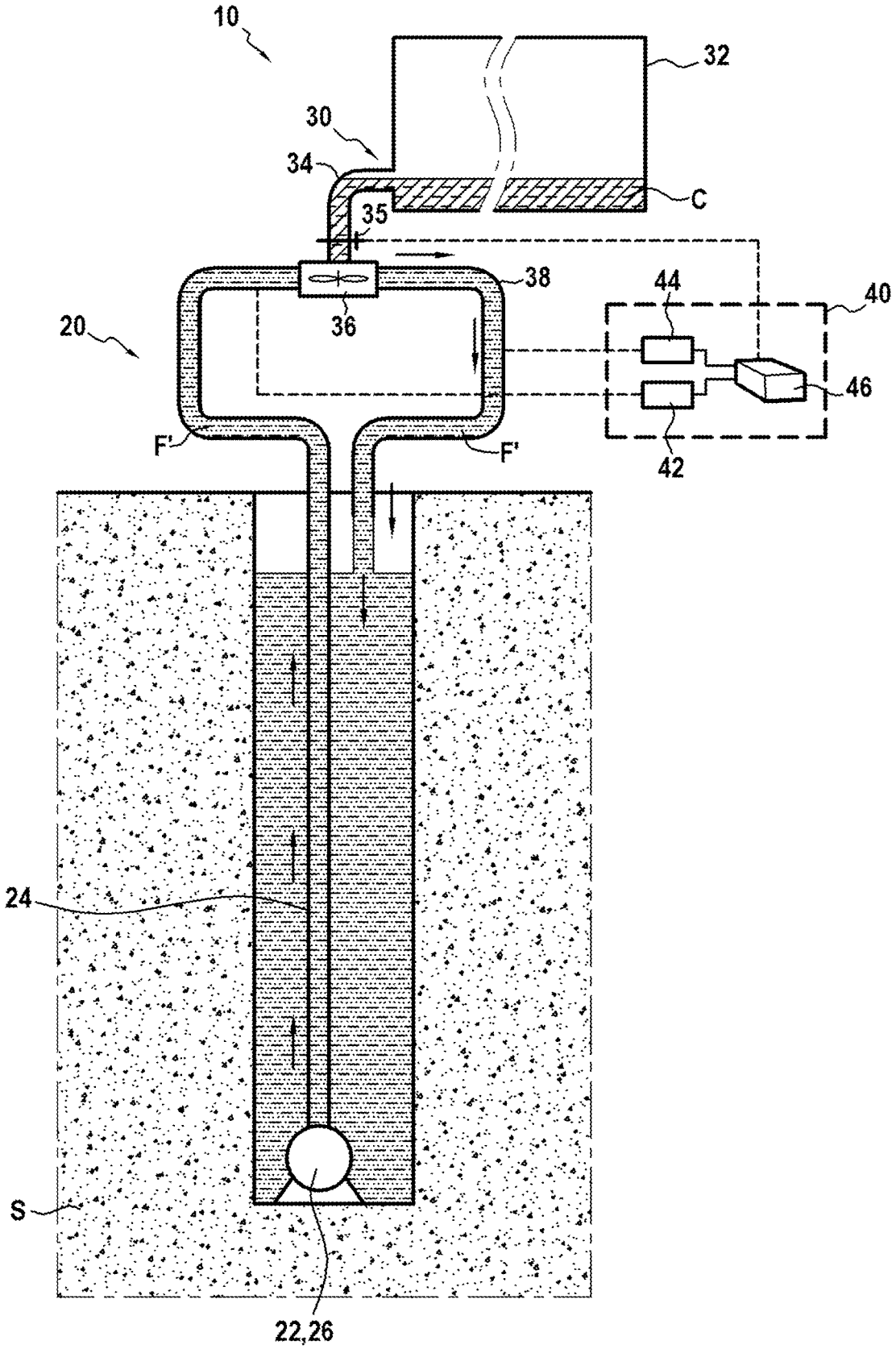

[Fig. 8]
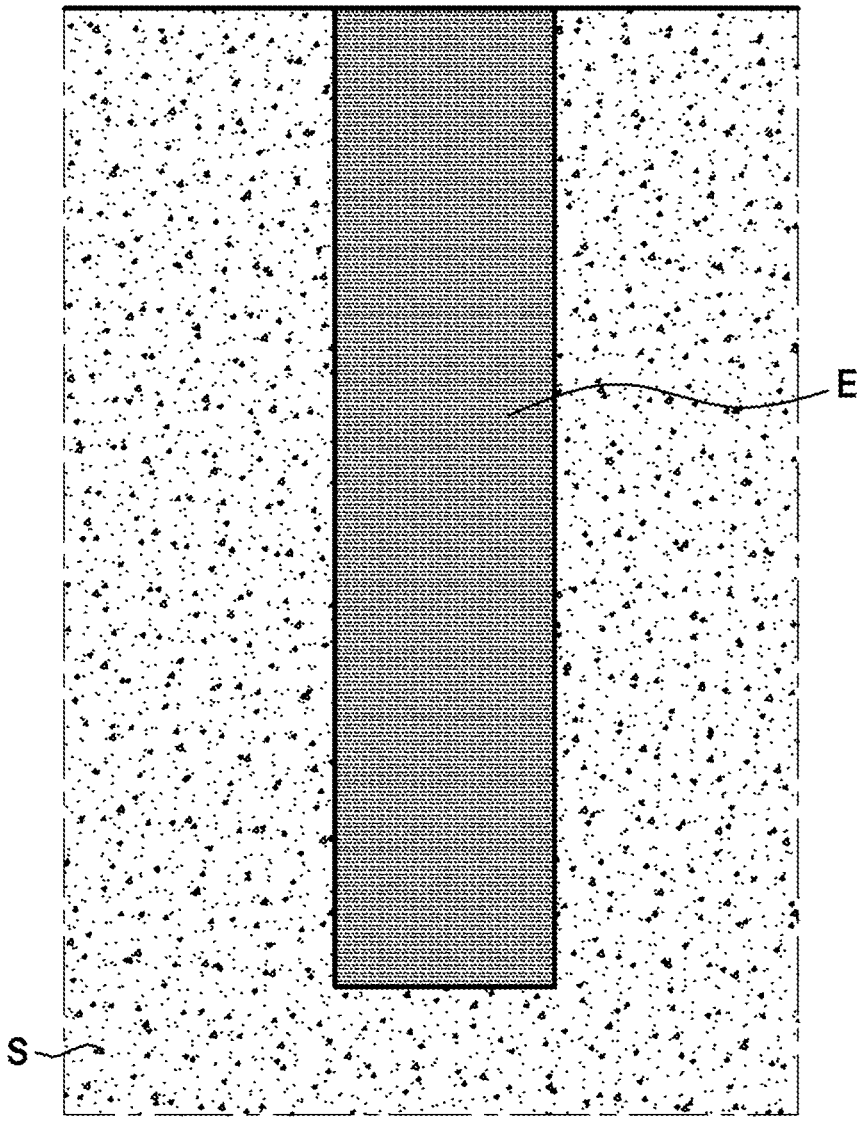

[Fig. 9]
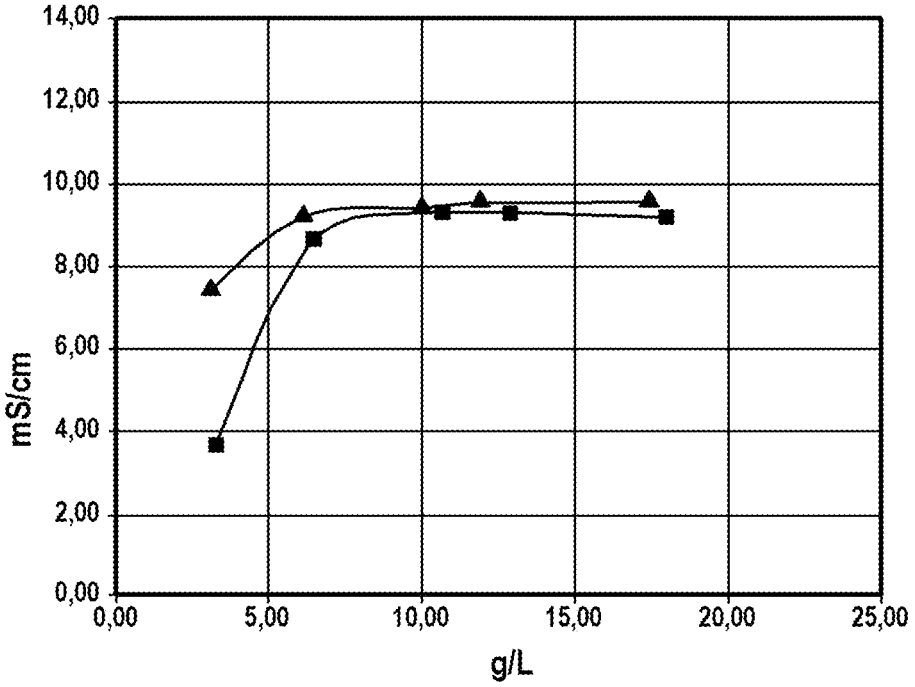
[Fig. 10]
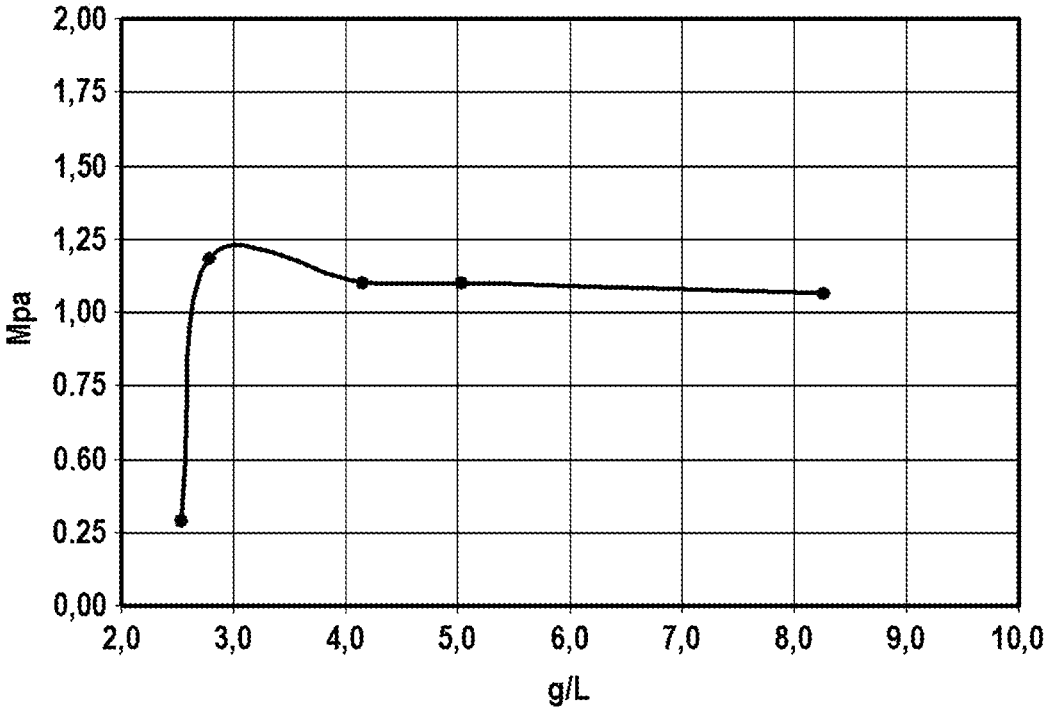

METHOD FOR MANUFACTURING AN ELEMENT COMPRISING A GROUT ACTIVATION CYCLE

TECHNICAL FIELD

The present disclosure relates to the field of in situ manufacturing of elements in the ground, for example temporary retaining screens or waterproofing screens.

The present disclosure relates in particular to the manufacture of grout walls in the ground at a great depth.

BACKGROUND

A method is known for forming a grout wall in the ground in which the excavation intended to receive the wall is drilled while injecting a cement grout into the excavation. During drilling, the cement grout acts as a drilling fluid and especially allows hydrostatic pressure to be exerted on the walls of the excavation in order to prevent them from collapsing. The cement grout then hardens in the excavation to form the wall.

A disadvantage of this method is that the hardening time of the cement grout is difficult to control and is sometimes insufficient to allow deep excavations or several successive excavations to be performed. Also, there is a significant risk that the excavation tool will become trapped in the hardened grout, in which case it is necessary to destroy the manufactured wall or abandon the cutting tool in the excavation. Consequently, for the implementation of this method, shovels and buckets, although less efficient, are preferred over Hydrofraise cutters, which are significantly more expensive and more problematic to abandon.

A method is also known for manufacturing an element in which the excavation is performed while injecting an inert drilling fluid. The drilling fluid is then replaced with a cement grout prepared above ground. This prevents the grout from setting during drilling and therefore eliminates the risk of the excavation tool getting stuck in the hardened grout.

A disadvantage of this method is that the density contrast between the drilling fluid and the cement grout is low. During replacement, part of the drilling fluid mixes with the cement grout in an inhomogeneous and uncontrolled manner. This has the consequence of deteriorating the physical properties of the element formed by hardening of this inhomogeneous mixture. This mixture turns out to be notably weaker.

It is also known to perform an excavation while injecting a drilling fluid then to introduce a highly concentrated cement grout into the excavation, and to mix the drilling fluid and the highly concentrated cement grout in situ, in order to form an element in the ground.

Here again, the mixture obtained in the excavation is not homogeneous over the entire excavation, so that the element obtained can be weakened in places. In addition, this method involves the costly installation of high-concentration grout manufacturing facilities. Furthermore, this method requires the evacuation of a volume of drilling fluid equivalent to the volume of highly concentrated cement grout introduced into the excavation, which imposes significant logistical constraints.

SUMMARY

An aim of the present disclosure is to propose a method for manufacturing an element in the ground remedying the aforementioned problems.

To do so, the present disclosure relates to a method for manufacturing an element in the ground, the method comprising:

- a drilling step during which an excavation is drilled into the ground using a drilling tool, while introducing into said excavation a grout comprising a first composition;
- after the drilling step, at least one grout activation cycle is performed during which:
  - at least part of the grout is pumped;
  - a second composition is added to the pumped grout configured to activate the grout by reacting with the first composition in order to initiate the hardening of said grout; then
  - the activated grout is introduced into the excavation;
- after said at least one grout activation cycle, the activated grout contained in the excavation is allowed to harden in order to form the element in the ground.

The method according to the present disclosure is particularly suitable for the in situ manufacture of grouted walls, for example temporary retaining screens or waterproofing screens. The method allows the manufacture of elements in very deep ground, for example several tens of meters deep.

In a non-limiting manner, the element to be manufactured can also be a prefabricated wall, a reinforced wall provided with a profile-type stiffening element, a waterproof wall provided with a High Density Polyethylene (HDPE) membrane or a reactive permeable barrier.

The geometry of the excavation depends on the drilling tool used. It may be a trench or a slender borehole, depending on the shape of the element to be manufactured. In a non-limiting manner, the drilling tool can be a shovel, a bucket or even a Hydrofraise cutter.

When drilling the excavation, the grout comprising the first composition introduced into the excavation plays the role of a drilling fluid. This grout exerts hydrostatic pressure on the walls of the excavation, keeping them in place and preventing them from collapsing. It also lubricates and cools the cutting tool and brings the drilling cuttings to the surface of the excavation.

Preferably, during said at least one activation cycle, at least part of the grout is pumped out of the excavation. Part of the grout is therefore extracted from the excavation.

The grout comprising the first composition is an inert and non-activated grout. This grout comprises an inactive binder. Hardening of the grout only occurs after injection of the second composition. Thus, during drilling, the hardening of the grout, as defined below, has not started and said grout is maintained in liquid form. The method according to the present disclosure therefore makes it possible to avoid the risk of trapping the drilling tool in the hardened grout and therefore having to destroy the formed element or abandon the drilling tool. By means of the method according to the present disclosure, it can therefore be envisaged to use efficient and expensive tools, such as a Hydrofraise cutter, without fear of damaging them or having to abandon them in the excavation.

In addition, the activation cycle can be performed subsequently and, in particular much later, for example several days, after the drilling step.

The grout comprising the first composition is preferably free of cement and in particular Portland cement and therefore has a reduced carbon footprint.

Activated grout means a grout whose hardening has been initiated. Hardening means a change, generated voluntarily, of the mechanical properties of the grout with a view to reaching a solid state allowing the formation of an element having satisfactory properties, particularly in terms of strength, generally within a period of less than 15 days.

Such hardening is distinguished from a possible natural and untriggered stiffening of a non-activated and unmixed grout, which may occur after a significant time, generally greater than 30 days.

The activated grout results from bringing the first composition present in the grout initially introduced during drilling into contact with the second composition. The activated grout forms a binder. The first composition of the grout introduced during drilling advantageously comprises at least one precursor component. Preferably, the grout also comprises water, in an amount of 75% to 97% of the volume of the activated grout ($m^3$) or in an amount of 49.6% to 90% of the mass of a tonne of grout.

The second composition forms an activation composition. It advantageously comprises at least one activator component configured to react with the precursor component of the first composition of the grout. The second composition is advantageously in liquid form and can be stored on the surface, for example in a tank. In a non-limiting manner, the second composition may be in powder form.

Preferably, after the drilling step and before performing said at least one activation cycle, the drilling tool is removed from the excavation.

Still more preferably, the excavated soil is extracted from the excavation before performing said at least one activation cycle, so that the method does not implement a technique of mixing the soil in place with a binder, also called a soil mixing technique.

Said at least one grout activation cycle is preferably continued until a quantity of grout deemed satisfactory has been activated.

In a non-limiting manner, only part of the grout introduced during drilling is pumped and activated during said at least one activation cycle. As a variant, the grout activation cycle can be interrupted when all of the grout introduced during drilling has been pumped, activated and then introduced into the excavation.

The activation is advantageously continued until the mixture in the excavation is judged to be homogeneous, and therefore when substantially all the grout has been activated. An advantage is to allow the formation of a stronger element than the elements formed according to the methods of the prior art, which are based on volume estimates and in which the mixture obtained in the excavation is not homogeneous over the entire excavation.

Still in a non-limiting manner, the grout activation cycle can be continued after all of the grout initially introduced during drilling has been pumped, activated, and then introduced into the excavation. In this case, already activated grout is pumped and the second composition is added to said already activated and pumped grout. An advantage is to increase the concentration of the second composition in the activated grout, in order to modify the physical properties of the manufactured element, for example to increase its strength. The grout is preferably pumped continuously.

In a non-limiting manner, the hardening of the activated grout can be fast, around a few hours, for example between 10 hours and 24 hours, or slow, around several days, for example between 3 and 7 days.

During the activation cycle, the non-activated grout is at least partially treated so as to activate it. Preferably, all the non-activated grout initially introduced into the excavation during drilling is activated, so that the excavation then contains only activated grout over its entire depth.

In a non-limiting manner, several successive activation cycles can be performed, in order to adapt the physical properties of the final activated grout and of the manufactured element.

By means of the method according to the present disclosure, the quantity of second composition added into the pumped grout and especially the quantity of second composition added for a given quantity of pumped grout is known with precision. The mass concentration of the second composition in the activated grout is controlled. According to the present disclosure, the second composition is introduced gradually and homogeneously into the pumped grout and the activation of the grout is controlled.

Furthermore, the activation of the grout does not change, or only very slightly changes, the density of said grout. Consequently, by means of the method according to the present disclosure, the mixture of activated grout and non-activated grout obtained in the excavation, after introduction of the activated grout, is homogeneous. This therefore makes it possible to overcome the inhomogeneity problems of the methods of the prior art, in which materials of different natures are mixed inhomogeneously in the excavation.

Contrary to the methods according to the prior art which provide for replacing the drilling fluid with a cement grout prepared above ground, the grout used in the method according to the present disclosure during drilling, as drilling fluid, is involved in the final composition of the manufactured item. An advantage is to reduce the quantity of materials used for drilling and manufacturing the element, and to avoid having to evacuate the drilling fluid. The costs associated with implementing the method according to the present disclosure are therefore reduced.

By means of the method according to the present disclosure, the activated grout and possibly a portion of non-activated grout are essentially present in the excavation, forming a particularly homogeneous mixture within the excavation. This mixture is significantly more homogeneous than the mixtures obtained according to the methods of the prior art, where the drilling fluid is replaced by a cement grout or mixed with a heavily concentrated cement grout in a coarse manner. The element formed using the method according to the present disclosure is therefore all the more solid and strong over its entire length and over its entire volume.

In addition, the method according to the present disclosure makes it possible to avoid the introduction of highly concentrated cement into the excavation, thus reducing the manufacturing costs of the element.

Preferably, the method further comprises a control step in which at least one physicochemical parameter of the pumped grout is measured and said at least one activation cycle is stopped when the value of said at least one physicochemical parameter becomes greater than a predetermined upper threshold or lower than a predetermined lower threshold. An advantage is to precisely control the activation of the grout and to control the homogeneity of the mixture obtained in the excavation, by means of which the formed element presents similar and chosen properties over its entire volume.

Said at least one physicochemical parameter measured on the pumped grout is an indicator of the activation of the grout and changes when the second composition is added to the pumped grout. The activation of the grout is therefore monitored.

Said upper or lower thresholds are advantageously, but in a non-limiting manner, predetermined empirically and advantageously depend on the nature of the soil in which the excavation is performed, on the nature of the first and second composition or even on the physical properties desired for the element to be manufactured. Said upper or lower thresholds can be determined on site, before starting the drilling stage. As a variant, the upper and/or lower thresholds can be predetermined during a preliminary study conducted in the laboratory.

In particular, the upper and/or lower thresholds preferably correspond to a value of said at least one physicochemical parameter reflecting satisfactory activation of the grout.

Preferably, when said upper or lower thresholds are reached by said at least one physicochemical parameter measured on the grout upstream of the zone of addition of the second composition, the mixture in the excavation is considered homogeneous and the activation criterion is considered reached.

Advantageously, and in a non-limiting manner, several distinct physicochemical parameters of the pumped grout are measured and said at least one activation cycle is stopped when the value of each of said physicochemical parameters becomes greater than a predetermined upper threshold or less than a predetermined lower threshold, associated with this physicochemical parameter. As a variant, the activation cycle can be stopped when only one of the physicochemical parameters reaches the upper or lower threshold associated with it.

Without exceeding the scope of the present disclosure, said at least one physicochemical parameter can be measured on the grout pumped into the excavation, for example, at the level of a suction nozzle of a pump intended to pump the grout, placed in the excavation. As a variant, said at least one physicochemical parameter can be measured on the pumped grout, outside the excavation.

Preferably, the predetermined upper threshold, respectively the predetermined lower threshold, is determined from said at least one physicochemical parameter measured for the activated grout. Said physicochemical parameter measured for the activated grout is used as a reference reflecting the activation of the grout. An advantage is that the upper or lower threshold is adjusted according to the properties of the activated grout and is particularly appropriate for the conditions of implementation of the method, for example to the nature of the soil or the grout. The control of the activation of the grout and the homogeneity of the grout present in the excavation following the activation cycle are further improved.

In this non-limiting embodiment, the physicochemical parameter is measured on the pumped grout and on the activated grout. It is understood that the upper or lower thresholds can change depending on the value of said physicochemical parameter measured for the activated grout.

Still more preferably, the predetermined upper threshold, respectively the predetermined lower threshold, is chosen substantially equal to the value of said at least one physicochemical parameter measured for the activated grout.

The value of said physicochemical parameter measured on the pumped grout is then directly compared to the value of said physicochemical parameter measured on the activated grout.

Said physicochemical parameter is preferably measured on the activated grout before its introduction into the excavation and again preferably immediately downstream of the addition of the second composition in the pumped grout, possibly after an optional step of mixing the pumped grout with the second composition.

When the value of the physicochemical parameter measured on the pumped grout reaches said upper or lower threshold, determined from said at least one physicochemical parameter measured for the activated grout, it can be considered that all of the grout initially introduced into excavation during drilling has been activated.

Advantageously, said at least one physicochemical parameter is chosen from conductivity, pH, viscosity, temperature or the concentration of a specific ion of the pumped grout. Such a physicochemical parameter varies during the reaction of the first composition of the grout with the second composition, and therefore during the activation of the grout. In other words, the value of these physicochemical parameters is indicative of whether the grout is activated. For example, the conductivity of the grout increases when the second composition is added. By specific ion we mean a chosen ion that can be used as an indicator. This is an ion whose concentration can be measured and whose concentration increases or decreases significantly upon activation of the grout. For example, it can be a chloride, sulphate or calcium ion.

Preferably, the physicochemical parameter of the pumped grout is measured on the surface, outside the excavation. An advantage is to measure the physicochemical parameter immediately before adding the second composition to the pumped grout, in order to determine the amount of the second composition to be added even more precisely. The measurement is also made easier.

Preferably, the amount of the second composition added in the pumped grout is adjusted during said at least one grout activation cycle, as a function of said physicochemical parameter measured on the pumped grout. In particular, the quantity of second composition added to the pumped grout can be reduced when the value of said physicochemical parameter measured on the pumped grout approaches the predetermined upper or lower threshold. In addition, the concentration of second composition added to the pumped grout can be increased if the evolution over time of the physicochemical parameter measured on the pumped grout is not sufficient.

Advantageously, said at least one grout activation cycle comprises, after adding the second composition to the pumped grout, a mixing step in which the pumped grout is mixed with the second added composition, using a mixing tool. An advantage is to improve the homogeneity of the activated grout, formed by mixing the pumped grout and the second composition, in order to improve the mechanical properties of the manufactured element.

Preferably, but in a non-limiting manner, the mixing step is performed online. The mixing tool may comprise a static stirrer or a mobile element, in order to facilitate mixing of the activated grout, particularly when the viscosity of the grout is high.

Advantageously, the mixture of the pumped grout with the second composition is performed above ground and/or in the excavation. The mixture can be performed exclusively above ground, exclusively in the excavation or jointly above ground and in the excavation.

When at least one physicochemical parameter is measured on the activated grout, said at least one physicochemical parameter is preferably measured downstream of said mixture. It is understood that when the mixture of the pumped grout with the second composition is performed above ground, said measurement can also be performed above ground.

Preferably, the grout is pumped from a lower part of the excavation, preferably near the bottom of the excavation, whereby any nonactivated grout, initially introduced into the excavation during drilling, can be pumped. The level of said nonactivated grout in the excavation gradually decreases during the activation cycle.

Pumping is advantageously performed by means of a pump having a suction nozzle placed in the bottom of the excavation. A suction conduit then extends between the suction nozzle and the surface.

Preferentially, the activated grout is introduced into the excavation in an upper part of said excavation. An advantage is to limit the mixing between the nonactivated grout initially introduced into the excavation during drilling and the activated grout introduced into the excavation during the activation cycle. It is specified that a possible mixing between the activated grout and the nonactivated grout within the excavation does not compromise the effectiveness of the method according to the present disclosure, in which the activation cycle is advantageously continued until activation of the grout initially present in the excavation.

During the activation cycle, the activated grout is introduced into the excavation so as to gradually fill it, replacing the nonactivated grout initially introduced during drilling. The activated grout will gradually fill the volume of the excavation from the top of the excavation to the bottom of the excavation, as the grout initially introduced during drilling is pumped out. So when the activated grout is pumped, it can be inferred that substantially all of the grout initially introduced during drilling has been activated.

As a variant, and in a non-limiting manner, the activated grout can be introduced into a lower part of the excavation while the grout is pumped from an upper part of the excavation.

Advantageously, the first composition of the grout comprises at least one non-activated aluminosilicate component or a silicate and aluminate compound.

Aluminosilicate component is understood to mean any material made up of silicates comprising aluminium (Al) in the form of oxides.

As a variant, and in a non-limiting manner, the first composition may comprise a mixture of several components, said mixture being a source of aluminosilicate. "A mixture of several components, said mixture being a source of aluminosilicate", is understood to mean any mixture providing silica and aluminium oxide.

Preferably, said at least one non-activated aluminosilicate component is chosen from: a blast furnace slag, fly ash, a calcined clay, for example of the metakaolin or kaolin type, a clay of the bentonite, kaolinite, smectite, illite, attapulgite or sepiolite type, or a mixture of these. These components are precursors able to react with activator components of the second composition to activate the pumped grout.

Preferably, said at least one non-activated aluminosilicate component comprises a mixture of blast furnace slag and bentonite.

As a variant, and in a non-limiting manner, the first composition may comprise a limestone filler (calcium carbonate and/or magnesium) and/or a siliceous filler.

Advantageously, the second composition comprises an alkaline preparation, for example an alkaline powder or an alkaline solution. Said alkaline preparation reacts with the first composition, and preferably with said at least one aluminosilicate component of the first composition, so as to activate the pumped grout.

Preferably, the alkaline preparation is an alkaline powder or an alkaline solution (liquid).

Advantageously, the first composition reacts with the alkaline preparation of the second composition to form a geopolymer or an activated alkali material.

Preferentially, the alkaline preparation is an alkaline preparation of sodium, potassium or calcium, in particular chosen from: a preparation of sodium or potassium carbonate; a preparation of sodium, potassium or calcium silicate; a preparation of sodium, potassium or calcium hydroxide; a preparation of calcium oxide; a preparation of sodium, potassium, or calcium sulphate; or quicklime, slaked lime or air lime, or a combination of these.

Preferably, the alkaline preparation comprises lithium salts.

Calcium oxide is also called quicklime.

Preferably, at least one of the first and second compositions comprises at least one adjuvant configured to delay or accelerate the hardening of the activated grout or to fluidize the activated grout. A benefit is to improve the control of the hardening of the activated grout. Hardening can for example be delayed to allow removal of the pumping means from the excavation and prevent it from being blocked in the hardened activated grout.

The present disclosure also relates to an installation for manufacturing an element in the ground, the installation comprising:

- a drilling tool configured to drill an excavation in the ground;
- an introduction device configured to introduce into the excavation, during drilling, a grout comprising a first composition;
- a grout activation device comprising:
  - a pumping means configured to pump the grout, after drilling;
  - a means of treating the grout configured to add into the pumped grout a second composition configured to activate the grout by reacting with the first composition in order to initiate hardening the of said grout;
  - a means of introducing activated grout into the excavation.

Preferably, the grout is pumped out of the excavation.

Preferably, the installation further comprises a control device comprising at least a first measuring instrument configured to measure at least one physicochemical parameter of the pumped grout, the control device being configured to stop the addition of the second composition into the pumped grout when the value of said at least one physicochemical parameter becomes greater than a predetermined upper threshold or becomes lower than a predetermined lower threshold.

Said predetermined upper and/or lower thresholds are advantageously chosen so that when said at least one physicochemical parameter reaches said predetermined upper threshold or said predetermined lower threshold, substantially all of the grout initially introduced during drilling has been activated.

Advantageously, said at least one first measuring instrument is disposed on the surface, outside the excavation, upstream of the grout treatment means. As a variant and in a non-limiting manner, said at least one first measuring instrument can be placed in the excavation, for example near the bottom of the excavation.

Advantageously, the control device comprises:

- at least one second measuring instrument disposed downstream of the grout treatment means and configured to measure said at least one physicochemical parameter for the activated grout; and a threshold determination module configured to determine the predetermined upper threshold, respectively the predetermined lower threshold, from said at least one physicochemical parameter measured for the activated grout.

In a non-limiting manner, the control device may comprise a control unit comprising the threshold determination means.

Preferably, the installation comprises a mixing tool configured to mix the pumped grout with the second composition added.

BRIEF DESCRIPTION OF THE DRAWINGS

The present disclosure will be better understood on reading the following description of embodiments of the present disclosure given by way of non-limiting examples, with reference to the attached drawings, in which:

FIG. 1 illustrates the initial state of a method for manufacturing an element according to the present disclosure;

FIG. 2 illustrates a drilling step of the method according to the present disclosure;

FIG. 3 illustrates a step of removing the drilling tool of the method according to the present disclosure;

FIG. 4 illustrates an installation for implementing the method according to the present disclosure;

FIG. 5 illustrates the start of the activation cycle of the method according to the present disclosure;

FIG. 6 illustrates an intermediate step of the activation cycle of the method according to the present disclosure;

FIG. 7 illustrates the end of the activation cycle;

FIG. 8 illustrates an element manufactured in the ground by means of the method according to the present disclosure;

FIG. 9 illustrates the change in the conductivity of the pumped grout as a function of the mass concentration of the second composition; and FIG. 10 illustrates the change in the compressive strength of the manufactured element as a function of the mass concentration of the second composition.

DESCRIPTION OF THE EMBODIMENTS

The present disclosure relates to a method for manufacturing an element in the ground. This method makes it possible to manufacture an element such as a temporary retaining screen or a waterproofing screen by activating a drilling grout.

Using FIGS. 1 to 7, we will describe a non-limiting embodiment of the method, in accordance with the present disclosure, for manufacturing an element E in the ground S. The method is implemented by means of an installation 10 manufacturing an element in the ground according to the present disclosure. This installation is also illustrated in FIGS. 1 to 7.

The installation 10 comprises a drilling machine 12, comprising a drilling tool 14, configured to drill an excavation into the ground S. The geometry of the excavation depends on the drilling tool 14. The tool here is cylindrical. As can be seen in FIG. 2, the installation 10 also comprises an introduction device 16 configured to introduce grout into an excavation. In this non-limiting example, the introduction device 16 comprises a spray nozzle disposed at the distal end of the drilling tool 12. As a variant, and in a non-limiting manner, the introduction device 16 may comprise a conduit opening at the head of the excavation and allowing the grout to be introduced into the excavation as said excavation is drilled.

As shown in FIG. 4, installation 10 further comprises a grout activation device 20. The grout activation device 20 comprises a pumping means 22. The pumping means 22 comprises suction conduit 24 configured to extend into an excavation and suction nozzle 26 arranged at the distal end of the suction conduit and configured to be disposed in an excavation.

The activation device 20 also comprises a treatment means 30 for a grout configured to add a second composition to the pumped grout. The treatment means 30 comprises tank 32 configured to receive said second composition and a treatment conduit 34. The treatment conduit 34 and the suction conduit 24 come together at a mixing tool 36. In this non-limiting example, the mixing tool 36 comprises an in-line mixer. In a non-limiting manner, the mixing tool may be static or comprise a mobile element. Treatment conduit 34 is fitted with a valve 35 capable of taking an open or closed position, which may or may not authorize the circulation of the second composition present in the tank towards the mixing tool 36.

The activation device 20 further comprises a means 38 for introducing an activated grout into an excavation. In this non-limiting example, the introduction means 38 consists of an introduction conduit configured to be connected to the mixing tool 36 and to open into an upper part of an excavation, close to the surface. The introduction means 38 could comprise an introduction nozzle disposed at the end of the introduction pipe.

In FIG. 4, it is noted that the installation 10 comprises a control device 40 comprising a first measuring instrument 42 and a second measuring instrument 44.

The first measuring instrument 42 is configured to measure at least one physicochemical parameter on a grout pumped from an excavation and circulating in the suction conduit 24, upstream of the grout treatment means 30, and upstream of the mixing tool 36. In this non-limiting example, the first measuring instrument 42 is configured to measure said physicochemical parameter on the surface, outside the excavation.

The second measuring instrument 44 is configured to measure at least one physicochemical parameter on an activated grout circulating in the introduction conduit 38 and intended to be introduced into the excavation. The second measuring instrument 44 is configured to measure said physicochemical parameter downstream of the grout treatment means 30 and the mixing tool 36.

The control device 40 further comprises a control unit 46 with which the first and second measuring instruments 42, 44 communicate. The control unit 46 is able to control the valve 35 in order to stop the circulation of the second composition from the tank 32 to the mixing tool 36, in particular depending on the physicochemical parameters measured by the first and second measuring instruments 42, 44. The control unit 46 comprises a threshold determination module.

The method for manufacturing an element in the ground will now be described in detail using FIGS. 1 to 7.

As shown in FIG. 1, the drilling machine 12 is initially supplied equipped with drilling tool 14. The ground S is devoid of excavation.

A drilling step is then performed, illustrated in FIG. 2, during which an excavation H is drilled into the ground using the drilling tool 14. During drilling, a grout F comprising a first composition is introduced into said excavation, using the introduction device 16. Said grout then plays the role of a drilling fluid. In particular, the grout allows hydrostatic pressure to be exerted on the walls of the excavation to prevent them from collapsing.

This grout F introduced during drilling is inert and non-activated, such that it is configured not to harden until the first composition reacts with an activating composition. The first composition of the grout comprises at least one non-activated aluminosilicate component chosen from: a blast furnace slag, fly ash, a calcined clay, for example of the metakaolin or kaolin type, a clay of the bentonite, kaolinite, smectite, illite, attapulgite, sepiolite type or a mixture of these.

During tests conducted by the inventors, the grout F is made up of water in an amount of 920 litres per cubic metre ($L/m^3$), bentonite in an amount of 45 kilograms per cubic metre ($kg/m^3$) and blast furnace slag in an amount of 185 $kg/m^3$. The density of this grout F is approximately 1.15. The first composition of the grout therefore comprises a mixture of bentonite and blast furnace slag.

The grout may also contain an adjuvant configured to delay or accelerate curing of the grout.

The retarding adjuvant can be chosen from the family of gluconates, lignosulfonates, calcium, sodium or ammonium phosphonates as well as from salts derived from citric acid, boric acid or sodium citrate.

The accelerator adjuvant can be chosen from calcium, sodium and ammonium salts, for example calcium carbonate, calcium chloride, calcium sulphate, calcium nitrate, sodium silicate, sodium aluminate.

The adjuvant can also be a superplasticizer chosen from the following families: polynaphthalene sulfonate, polymelamine sulfonate, polycarboxylate ether, sodium polyacrylate, pyrophosphate or sodium hexametaphosphate.

As shown in FIG. 3, and in a non-limiting manner, the drilling tool 14 is extracted from the excavation H. Excavation H is then filled with non-activated grout F introduced during the drilling step by means of the introduction device 16.

As can be seen in FIG. 4, the elements of the installation 10 allowing the activation of the grout F are then put in place, and in particular the activation device 20, the treatment means 30 and the control device 40. The suction conduit 24 of the pumping means 22 is disposed in the excavation so that the suction nozzle 26 extends near the bottom of the excavation H. The introduction conduit 38 is connected to the mixing tool 36 and is positioned so as to open into an upper part of the excavation H, close to the surface.

The suction conduit 26 and the introduction conduit 38 are initially empty while the tank 32 is filled with a second composition C. The valve 35 is initially closed. This second composition C is an activation composition, comprising activator components. This second composition C is configured to react with the first composition of the grout F initially introduced into the excavation H when drilling, in order to activate this grout F and initiate its hardening.

In a non-limiting manner the second composition C comprises an alkaline preparation, which is in this non-limiting example an alkaline solution, which may be an alkaline solution of sodium, potassium or calcium, in particular chosen from: a solution of sodium or potassium carbonate; a solution of sodium, potassium or calcium silicate; a solution of sodium, potassium or calcium hydroxide; or a solution of calcium oxide; or a combination of these.

In a non-limiting manner, the alkaline solution could be replaced by an alkaline powder consisting of the same compounds as the alkaline solution.

During the tests, and in a non-limiting manner, the inventors retained a second composition C comprising limewater (CaO), or quicklime, at a rate of 20 $L/m^3$.

This second composition may also contain an adjuvant configured to delay or accelerate the hardening of the grout or to fluidize it.

Then an activation cycle for the grout F present in the excavation H is performed using activation device 20, illustrated in FIGS. 5 to 7.

During this activation cycle, as illustrated in FIG. 5, a step of pumping the grout F is performed using the pumping means 22. Grout F is sucked up by the suction nozzle 26 from the bottom of the excavation H and is transported to the surface, outside the excavation, via the interior of the suction conduit 24. The grout F is brought to the treatment means 30.

In conjunction with the activation cycle, a control step is performed during which, using the first measuring device 42, a plurality of physicochemical parameters on the pumped grout F is measured. These physicochemical parameters are measured outside the excavation, upstream of the treatment means 30 and the addition of the second composition C. As a variant, these physicochemical parameters could be measured in the excavation, for example at the suction nozzle 26.

In this non-limiting example, the pH, conductivity and density of the pumped grout F are measured. The initial pH measured on the pumped grout, before starting the addition of the second composition C, is 9.9. The initial conductivity of the pumped grout is 1.32 millisiemens per centimetre (mS/cm) and the initial density of the pumped grout is 1.15.

Said physicochemical parameters are advantageously measured continuously throughout the activation cycle. An advantage is to be able to follow the evolution of these parameters.

As shown in FIG. 5, the activation cycle further comprises a step according to which the second composition C is added into pumped grout F, using said treatment means 30. More precisely, the valve 35 is open to allow the flow of the second composition C and bringing the pumped grout F into contact with the second composition. Bringing the first composition of the pumped grout, comprising bentonite and blast furnace slag, into contact with the second composition C comprising calcium oxide has the effect of activating the pumped grout F and initiating its hardening, by reaction of the second composition with the first composition.

Pumping of the grout from the excavation is continued during this step of adding the second composition C.

After adding the second composition C into the pumped grout, the pumped grout F is mixed with the second composition C added using the blender tool 36. An advantage is to improve the homogeneity of the mixture obtained and therefore of the activated grout F'. At the output of the mixing tool 36, activated grout F' circulates in the introduction conduit 38. As a variant, mixing could be performed in the excavation.

The activated grout F' is then introduced into the excavation, routing it into the excavation H by means of the introduction conduit 38, as indicated by the arrows in FIG. 5. Activated grout F' is introduced into the upper part of the excavation, close to the surface.

By continuing the activation cycle, and as illustrated by going from FIG. 5 to FIG. 6, activated grout F' gradually takes the place of the non-activated grout F within the excavation H. In the excavation, the amount of non-activated grout F, initially introduced during drilling, gradually decreases, while the activated grout F' is gradually driven towards the bottom of the excavation H and gradually fills said excavation, as illustrated in the intermediate step of FIG. 6.

In this non-limiting example, the physicochemical parameters mentioned above are also measured, i.e., pH, conductivity and density on the activated grout F'. This measurement is performed using the second measuring instrument 44, downstream of the addition of the second composition C and downstream of the mixing tool 36. The measurement is performed on the surface, outside the excavation, but could be performed in the excavation. The values of these physicochemical parameters serve as references and indicators of grout activation.

The activation cycle is continued, and the physicochemical parameters continue to be measured on the pumped grout F and on the activated grout F'. These parameters change over time.

Each of the physicochemical parameters measured is associated with an upper threshold or a lower threshold. The upper and lower thresholds are determined by a threshold determination module of the control unit 46 of the control device 40. In this non-limiting example, the upper and/or bas predetermined thresholds are determined for each of the three physicochemical parameters from said physicochemical parameters measured for the activated grout F', using the second measuring instrument 44. More precisely, the value of said physicochemical parameters measured on the activated grout F' is chosen as a predetermined upper threshold for these parameters. In accordance with the measurements made on the activated grout, the predetermined upper threshold for pH is set at 12, the predetermined upper threshold for conductivity is set at 8.5 mS/cm+/−0.5 mS/cm and the predetermined upper threshold for density is set at 1.16.

When the value of at least one of the physicochemical parameters measured by the first measuring instrument 42 becomes greater than the predetermined upper threshold associated with it, the activation cycle is stopped. To do this, the control unit 46 of the control device 40 compares the value of the physicochemical parameters measured on the pumped grout F at the predetermined upper thresholds. The control unit 46 then orders the interruption of the addition of the second composition into the pumped grout F, which is reflected in this non-limiting example by the closing of the valve 35. It is then considered that all of the grout initially introduced during drilling has been activated or, at the very least, a satisfactory quantity of grout has been activated.

For example, FIG. 7 illustrates a final state of the activation cycle in which all of the grout has been activated. It is seen that the excavation is entirely filled with activated grout F'. As a result, all of the grout has been activated and the already activated grout is now pumped. The values of the physicochemical parameters measured on the pumped grout are then substantially equal to the values of said parameters measured on the activated grout, and greater than or equal to the predetermined upper thresholds.

Grout pumping is interrupted. Then the activation device 20 and the treatment means 30 are removed and the activated grout is allowed to harden in the excavation, until the element is formed in the ground.

FIG. 8 illustrates the element E formed in the ground S, by implementing the method according to the present disclosure, described previously.

FIG. 9 illustrates the change in conductivity, measured using the first measuring instrument 42, of the grout pumped during the activation cycle, depending on the mass concentration of second composition C added into the pumped grout F, for two different grouts. It is seen that the conductivity gradually increases with the introduction of the second composition C into the pumped grout, until reaching a maximum. This maximum corresponds to the total activation of the pumped grout, and the predetermined upper threshold can be set slightly lower than this maximum.

Beyond this maximum, the conductivity no longer increases, so that the introduction of the second composition can be stopped. Activation of the grout is achieved, and the grout is then saturated with activator.

FIG. 10 illustrates the change in the compressive strength, expressed in Megapascals (MPa) measured using the first measuring instrument 42, on a grout pumped during the activation cycle, as a function of the mass concentration of second composition C added in the pumped grout F.

It is noted that the compressive strength increases with the addition of the second composition C, until reaching a maximum, then remains constant once this maximum is reached. The addition of the second composition can then be interrupted.

The invention claimed is:

1. A method for manufacturing an element in the ground, the method comprising:

a drilling step during which an excavation is drilled into the ground using a drilling tool, while introducing into said excavation a grout comprising a first composition;

after the drilling step, at least one grout activation cycle is performed during which:

at least part of the grout is pumped;

a second composition is added to the pumped grout configured to activate the grout by reacting with the first composition in order to initiate the hardening of said grout; then the activated grout is introduced into the excavation; and after said at least one grout activation cycle, the activated grout contained in the excavation is allowed to harden in order to form the element in the ground.

2. The method according to claim 1, further comprising a control step in which at least one physicochemical parameter of the pumped grout is measured and said at least one grout activation cycle is stopped when the value of said at least one physicochemical parameter becomes greater than a predetermined upper threshold or lower than a predetermined lower threshold.

3. The method according to claim 2, wherein the predetermined upper threshold, respectively the predetermined lower threshold, is determined from said at least one physicochemical parameter measured for the activated grout.

4. The method according to claim 2, wherein said at least one physicochemical parameter is chosen from conductivity, pH, viscosity, temperature or the concentration of a specific ion of the pumped grout.

5. The method according to claim 2, wherein the physicochemical parameter of the pumped grout is measured on the surface, outside the excavation.

6. The method according to claim 2, wherein the amount of the second composition added in the pumped grout is adjusted during said at least one grout activation cycle, as a function of said physicochemical parameter measured on the pumped grout.

7. The method according to claim 1, wherein said at least one grout activation cycle for grout comprises, after adding the second composition to the pumped grout, a mixing step in which the pumped grout is mixed with the second added composition, using a mixing tool.

8. The method according to claim 7, wherein the mixture of the pumped grout with the second composition is performed above ground and/or in the excavation.

9. The method according to claim 1, wherein the grout is pumped from a lower part of the excavation.

10. The method according to claim 9, wherein the grout is pumped near the bottom of the excavation.

11. The method according to claim 1, wherein the activated grout is introduced into the excavation in an upper part of said excavation.

12. The method according to claim 1, wherein the first composition of the grout comprises at least one non-activated aluminosilicate component or a silicate and aluminate compound.

13. The method according to claim 12, wherein said at least one non-activated aluminosilicate component is chosen from: a blast furnace slag, fly ash, a calcined clay, a clay of the bentonite, kaolinite, smectite, illite, attapulgite or sepiolite type, or a mixture of these.

14. The method according to claim 13, wherein said at least one non-activated aluminosilicate component is a calcined clay of the metakaolin or kaolin type.

15. The method according to claim 1, wherein the second composition comprises an alkaline preparation.

16. The method according to claim 15, wherein the alkaline preparation is an alkaline preparation of sodium, potassium or calcium.

17. The method according to claim 16, wherein the alkaline preparation is chosen from: a preparation of sodium or potassium carbonate; a preparation of sodium, potassium or calcium silicate; a preparation of sodium, potassium or calcium hydroxide; a preparation of calcium oxide; a preparation of sodium, potassium, or calcium sulphate; or quicklime, slaked lime or air lime, or a combination of these.

18. The method according to claim 15, wherein the second composition comprises an alkaline powder or an alkaline solution.

19. The method according to claim 1, wherein at least one of the first and second compositions comprises at least one adjuvant configured to delay or accelerate the hardening of the activated grout or to fluidize the activated grout.

20. An installation for manufacturing an element in the ground, the installation comprising:

a drilling tool configured to drill an excavation in the ground;

an introduction device configured to introduce into the excavation, during drilling, a grout comprising a first composition; and a grout activation device comprising:

a pumping means configured to pump the grout, after drilling;

a means for treating the grout configured to add into the pumped grout a second composition configured to activate the grout by reacting with the first composition in order to initiate the hardening of said grout; and a means of introducing activated grout into the excavation.

21. The installation according to claim 20, further comprising a control device comprising at least a first measuring instrument configured to measure at least one physicochemical parameter of the pumped grout, the control device being configured to stop the addition of the second composition into the pumped grout when the value of said at least one physicochemical parameter becomes greater than a predetermined upper threshold or becomes lower than a predetermined lower threshold.

22. The installation according to claim 21, wherein said at least one first measuring instrument is disposed on the surface, outside the excavation, upstream of the grout treatment means.

23. The installation according to claim 21, wherein the control device comprises:

at least one second measuring instrument disposed downstream of the grout treatment means and configured to measure said at least one physicochemical parameter for the activated grout; and a threshold determination module configured to determine the predetermined upper threshold, respectively the predetermined lower threshold, from said at least one physicochemical parameter measured for the activated grout.

24. The installation according to claim 20, comprising a mixing tool configured to mix the pumped grout with the second composition added.

25. An installation for manufacturing an element in the ground, the installation comprising:

a drilling tool configured to drill an excavation in the ground;

an introduction device configured to introduce into the excavation, during drilling, a grout comprising a first composition; and a grout activation device configured to:

pump the grout, after drilling;

add into the pumped grout a second composition configured to activate the grout by reacting with the first composition in order to initiate the hardening of said grout; and introduce activated grout into the excavation.

* * * * *